United States Patent [19]

Rowe

[11] Patent Number: 4,707,253

[45] Date of Patent: Nov. 17, 1987

[54] SWIMMING POOL SKIMMER ACCELERATOR

[76] Inventor: Ray Rowe, R. 4, Box 118, DeSoto, Mo. 63020

[21] Appl. No.: 910,014

[22] Filed: Sep. 22, 1986

[51] Int. Cl.[4] ..... E04H 3/20

[52] U.S. Cl. ..... 210/169; 210/232; 210/241

[58] Field of Search ..... 210/169, 525, 241, 538, 210/232, 540, 776, 416.2, 242.1; 15/1.7

[56] References Cited

U.S. PATENT DOCUMENTS

| | | | |
|---|---|---|---|
| 2,792,943 | 5/1957 | MacKintosh | 210/169 |
| 2,985,308 | 5/1961 | Koupal | 210/169 |
| 3,152,076 | 10/1964 | Kreutzer | 210/169 |
| 3,244,284 | 4/1966 | Shaffer | 210/169 |
| 3,625,364 | 12/1971 | La Chance | 210/169 |
| 3,774,767 | 11/1973 | Field | 210/169 |
| 4,068,327 | 1/1978 | Heinlein | 210/169 |
| 4,221,662 | 9/1980 | Joseph | 210/169 |
| 4,225,436 | 9/1980 | Cseh | 210/169 |
| 4,264,444 | 4/1981 | Bronnec | 210/242.3 |
| 4,455,695 | 6/1984 | Mikhel | 210/169 |
| 4,464,261 | 8/1984 | Cullen et al. | 210/282 |
| 4,495,072 | 1/1985 | Fields | 210/315 |
| 4,602,996 | 7/1986 | Willinger | 210/169 |
| 4,622,148 | 11/1986 | Willinger | 210/169 |

*Primary Examiner*—Peter Hruskoci
*Assistant Examiner*—Coreen Y. Lee
*Attorney, Agent, or Firm*—Warren D. Flackbert

[57] ABSTRACT

A swimming pool skimmer accelerator characterized as a pool water diverting blade arranged to effectively direct debris to a conventional swimming pool skimmer more positively than any prior approach. The skimmer accelerator herein is both vertically and horizontally adjustable, the former to permit pool usage without a physical obstacle and the latter to receive an optimum amount of debris filled oncoming water. The skimmer accelerator includes a blade which is selectively movable vertically to an optimum in-water depth.

2 Claims, 2 Drawing Figures

FIG. 1
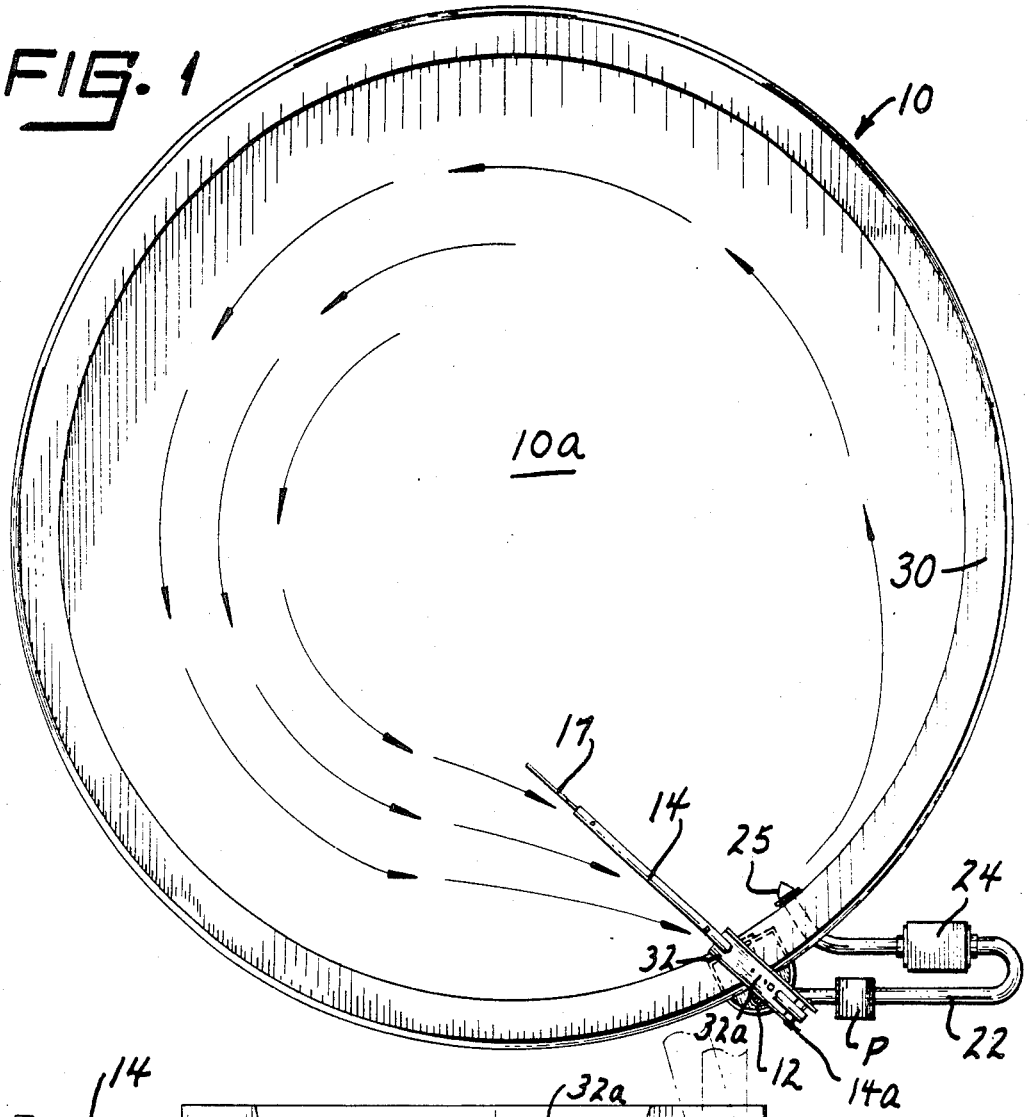
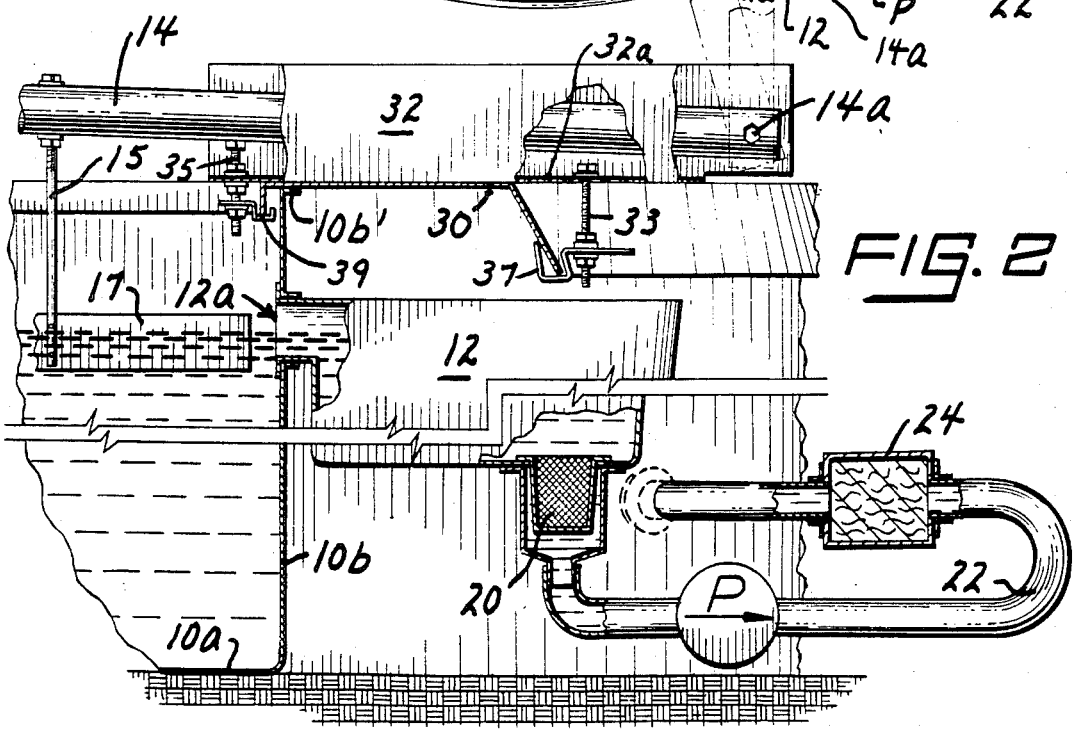
FIG. 2

SWIMMING POOL SKIMMER ACCELERATOR

As is known, the popularity of swimming pools, both public and private, is widespread, where, however, a major problem with such involves maintenance. In this connection, skimming plays importance, i.e. the collection of leaves or other floatable debris before becoming waterlogged and sinking to the bottom of the pool—the latter usually requiring vacuuming for best appearance and, as well, to prevent algae growth beneath the sunken matter.

In any event, skimming is generally accomplished through water current flow, by suction or like withdrawal, to one or more skimmers located around the edge of the pool and partly below the water level. Each skimmer is typically provided with a removable sieve or perforated bucket—which catches the debris as such passes in the water flowing to the suction line.

The invention affords more effective skimming action by presenting an arrangement, in combination with current flow, which includes an accelerator for diverting a given depth of flowing water or current to a conventional skimmer, i.e. channels the undesirable floating debris, leaves, bugs, airborne dust and the like into a skimmer in a skimming procedure which is greatly accelerated in comparison to that available heretofore.

Briefly, the invention is characterized by a longitudinal support member, extending over the surface of the water in the pool, carrying a blade which is submerged into the water at a preselected depth, such as two to three inches. The support member, pivotally mounted at the edge of the pool, is angularly disposed in a facing relationship with the oncoming major stream of current. In other words, the invention serves a combining effect to achieve the needed skimming, i.e. the current flow and the diverting achieved by the accelerator.

In any event, a better understanding of the present invention will become more apparent from the following description, taken in conjunction with the accompanying drawing, wherein

DESCRIPTION OF THE FIGURES

FIG. 1 is a top plan view of a swimming pool utilizing a skimmer accelerator in accordance with the teachings of the present invention; and, FIG. 2 is a view in vertical section, partly fragmentary, further detailing the skimmer accelerator arrangement of FIG. 1.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, a typical aboveground swimming pool 10 is disclosed, being circular in plan configuration and made from a reinforced plastic resin. The pool 10 is defined by a bottom wall 10*a* and a side wall 10*b* having an outwardly extending flanged portion 10*b*'. Further, pool 10 includes a drain (not shown) and a conventional skimmer 12 communicating, through a port 12*a*, to the inside of the pool 10, being at a level permitting water passage during ordinary operating conditions.

The skimmer arrangement of the invention includes an elongated support member 14, typically tubular, mounting a blade 17 through bolt members 15, where the ends of the latter are threaded for positive securement to the support member 14 and to the blade 17. The latter may be vertically adjustable, and, preferably, extends two to three inches into the water (if too deep, the water flow pattern might be impeded).

Before further detailing the invention, and noting FIG. 2 particularly, skimmer 12 retains, on its bottom surface 12*a*, a mesh or perforated strainer 20, where a pump P is provided in suction line 22 and a filter 24 in the return water flow path to the pool. A water inlet 25, mounted on the inner surface of side wall 10*b*, serves to direct water flow in a desired pattern (indicated by the directional arrows in FIG. 1). As debris accumulates in strainer 20, the latter is physically removed for emptying. In any event, a skimming procedure is known.

In order to position elongated support member 14, a commonly known sectioned pool seat 30 extends over and along the flanged portion 10*b*' of side wall 10*b* and mounts a channel member 32 (U-shaped and opening upwardly—see FIG. 1), where a pin or axle 14*a*, transverse therewith, serves to permit pivotal movement of elongated support member 14 (from the solid line position to the phantom line positions of FIG. 2), i.e. to permit unobstructed swimming.

As to positive horizontal placement of channel member 32, i.e. its angular relationship with side wall 10*b*—preferably about 60° in the direction of oncoming water flow—positioning bolts 33–35 extend downwardly through and from the bottom of channel member 32, bolt 33 cooperating with one of a series of bolt holes 32*a* and with a retaining member 37 located at the outward end of the sectioned pool seat 30 and bolt 35 cooperating with a retaining member 39 located at the inward end of the sectioned pool seat 30.

Bolt holes 32*a* determine elongated support member 14 position with respect to side wall 10*b*, where the tightening of both bolts 33 and 35 assures such placement. Additionally, the head of bolt 35 serves as a stop (against downward movement) of elongated support member 14 and, as well, also serves to define its vertical or inclined use angle.

In operation, and with the current flow illustrated in FIG. 1, the skimmer arrangement described herein serves for effective water flow diversion and important acceleration of the skimming procedure. Accumulated debris is directed to the skimmer 12, resulting in and achieving optimum end results, i.e. minimized maintenance for the owner/operator.

The swimming pool skimmer arrangement described herein is susceptible to various changes within the spirit of the invention, including, for example, proportioning; particular mounting for angular adjustment, both horizontal and vertical; material selection; and, the like. Thus, the preceding should be considered illustrative and not as limiting the scope of the following claims:

I claim:

1. A skimmer accelerator for a swimming pool having a side wall, a water inlet introducing water into said pool in a preselected flow pattern, and a skimmer mounted on said side wall and communicating with said water comprising a vertically pivotal support member positioned on side wall proximate said skimmer and extending above said water, wherein said vertically pivotal support member is electively positionable by a bolted fastener means to secure said vertically pivotal support member at a preselected angular location in a horizontal plane for accommodating water speed, and a blade supported on and below said vertically pivotal support member extending a preselected depth into said water and in a facing relationship with the oncoming flow of said water, wherein said blade is vertically adjustable independently of said vertically pivotal support member to any selected in-water depth, and wherein said vertically pivotal support member and said blade assume an acute angle with respect to said side wall in a diverting relationship between said preselected water flow pattern and said skimmer.

2. The skimmeer accelerator of claim 1 including means for selectively inclining said vertically pivotal support member during use of said skimmer.

* * * * *

UNITED STATES PATENT AND TRADEMARK OFFICE

CERTIFICATE OF CORRECTION

PATENT NO. : 4,707,253

DATED : November 17, 1987

INVENTOR(S) : Ray Rowe

It is certified that error appears in the above-identified patent and that said Letters Patent is hereby corrected as shown below:

Column 2, line 67, after "on" insert -- said --.

Column 3, line 1, "electively" should read -- selectively --.

Signed and Sealed this

First Day of March, 1988

*Attest:*

*Attesting Officer*

DONALD J. QUIGG

*Commissioner of Patents and Trademarks*